US009217618B1

(12) United States Patent
Miller, III

(10) Patent No.: US 9,217,618 B1
(45) Date of Patent: Dec. 22, 2015

(54) TOOL-LESS TRIGGER GUARD

(71) Applicant: Spike's Tactical, LLC, Apopka, FL (US)

(72) Inventor: Thomas James Miller, III, Lehigh Acres, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 14/719,899

(22) Filed: May 22, 2015

Related U.S. Application Data

(60) Provisional application No. 62/008,718, filed on Jun. 6, 2014.

(51) Int. Cl.
*F41A 19/11* (2006.01)

(52) U.S. Cl.
CPC ..... *F41A 19/11* (2013.01)

(58) Field of Classification Search
CPC ..... F41A 17/54; F41A 19/11; F41A 19/15; F41C 9/085
USPC ..... 42/90, 106
See application file for complete search history.

(56) References Cited

U.S. PATENT DOCUMENTS

| | | | | | |
|---|---|---|---|---|---|
| 2,590,858 | A * | 4/1952 | Harvey | F41A 19/11 | 42/69.01 |
| 3,106,795 | A * | 10/1963 | Wilson | F41A 19/11 | 42/69.03 |
| 3,195,259 | A * | 7/1965 | Meunier | F41A 17/54 | 42/41 |
| 3,964,200 | A * | 6/1976 | Patterson | F41A 19/11 | 42/70.06 |
| 7,786,397 | B2 * | 8/2010 | Dick | B25C 1/008 | 200/332.2 |
| D627,415 | S * | 11/2010 | Finn | D22/108 | |
| 8,984,794 | B1 * | 3/2015 | Saur | F41C 27/00 | 42/108 |
| 9,003,685 | B1 | 4/2015 | Huang | | |
| 2011/0173859 | A1 | 7/2011 | Findlay | | |

* cited by examiner

*Primary Examiner* — Reginald Tillman, Jr.
(74) *Attorney, Agent, or Firm* — Wood, Herron & Evans, LLP

(57) ABSTRACT

Provided is a trigger guard for an AR15-type firearm lower receiver, attachable and removable without application of impact force. It includes an elongated trigger guard member having forward and rear ends with a rear transverse opening positioned to align with mounting openings on the receiver. A mounting pin has a size no greater in cross-section than that of the mounting openings on the receiver and a spring engagement means thereon. A deflectable spring means is operably positioned in the transverse opening to be deflected when the pin is inserted in the transverse opening and to engage the spring engagement means on the mounting pin when the mounting pin reaches a preselected position.

8 Claims, 3 Drawing Sheets

TOOL-LESS TRIGGER GUARD

RELATED APPLICATION

This application claims priority to and the benefit of U.S. Provisional Patent Application No. 62/008,718, filed Jun. 6, 2014.

FIELD OF THE INVENTION

This invention relates to a trigger guard for use with a standard or mil-spec AR15/M16 lower receiver. More specifically, this trigger guard can be installed without the use of specialized tools and with reduced risk of damage to the mounting tabs on the lower receiver.

BACKGROUND OF THE INVENTION

A standard or mil-spec lower receiver for an AR15- or M16-platform rifle uses a lower trigger guard that is a separate piece and is attachable at forward and rearward ends to standardized mounting points on the lower receiver body. The standard trigger guard mounts at its rearward end by use of a roll pin hammered or pressed through a first tab extending from the lower receiver, through a transverse opening in the trigger guard, and through a second opening in a second mounting tab on the lower receiver. The forward end has a spring detent on the right side which is inserted to releasably engage an opening in the right side forward mounting tab extending from the lower receiver.

The nature of a common roll pin (also called spring pin or tension pin) is that it has a body diameter which is larger than the hole diameter for which it is intended to be used, and a chamfer on one or both ends to facilitate starting the pin into the hole. The body of the pin is split longitudinally or helically, providing a spring action that allows the diameter of the pin to compress as it assumes the diameter of the hole. The radially outward force exerted by the pin against the hole wall retains it in the hole, making it a self-retaining fastener. Installation requires, however, that the roll pin be hammered or forcibly pressed into position. In the case of the AR15/M16-platform lower receiver, the mounting holes for the trigger guard are in relatively thin tabs extending from the lower receiver body. If care is not taken as the trigger guard roll pin is hammered or pressed into place, a mounting tab can be broken. This is one of the most common breakage points on the lower receiver, often occurring during initial assembly.

An alternative attachment means for a trigger guard that does not add unnecessary bulk, parts, or complexity and that can be installed without having to hammer or force a roll pin through the mounting tabs of a lower receiver is desired.

SUMMARY OF THE INVENTION

The present invention provides a trigger guard for an AR15-type firearm lower receiver that is attachable and removable without application of impact force. It includes an elongated trigger guard member having forward and rear ends with a rear transverse opening positioned to align with mounting openings on the receiver. A mounting pin is provided having a size no greater in cross-section than that of the mounting openings on the receiver and a spring engagement means thereon. A deflectable spring means is operably positioned in the transverse opening to be deflected when the pin is inserted in the transverse opening and to engage the spring engagement means on the mounting pin when the mounting pin reaches a preselected position.

The trigger guard member may also be curved to provide an enlarged trigger opening. At least one elastomeric buffer member may be positioned on the trigger guard member to contact a surface of the receiver when installed to prevent movement between the installed trigger guard and the receiver. if desired, an elastomeric buffer member may be placed adjacent both the forward and rear ends of the trigger guard member.

Other aspects, benefits, and features of the present invention may be apparent to a person of skill in this art by reference to the following specification, drawing figures, and claims, all of which are part of the disclosure of the invention.

BRIEF DESCRIPTION OF THE DRAWING

Like reference numerals are used to indicate like parts throughout the various figures of the drawing, wherein.

DETAILED DESCRIPTION

Figure 1:
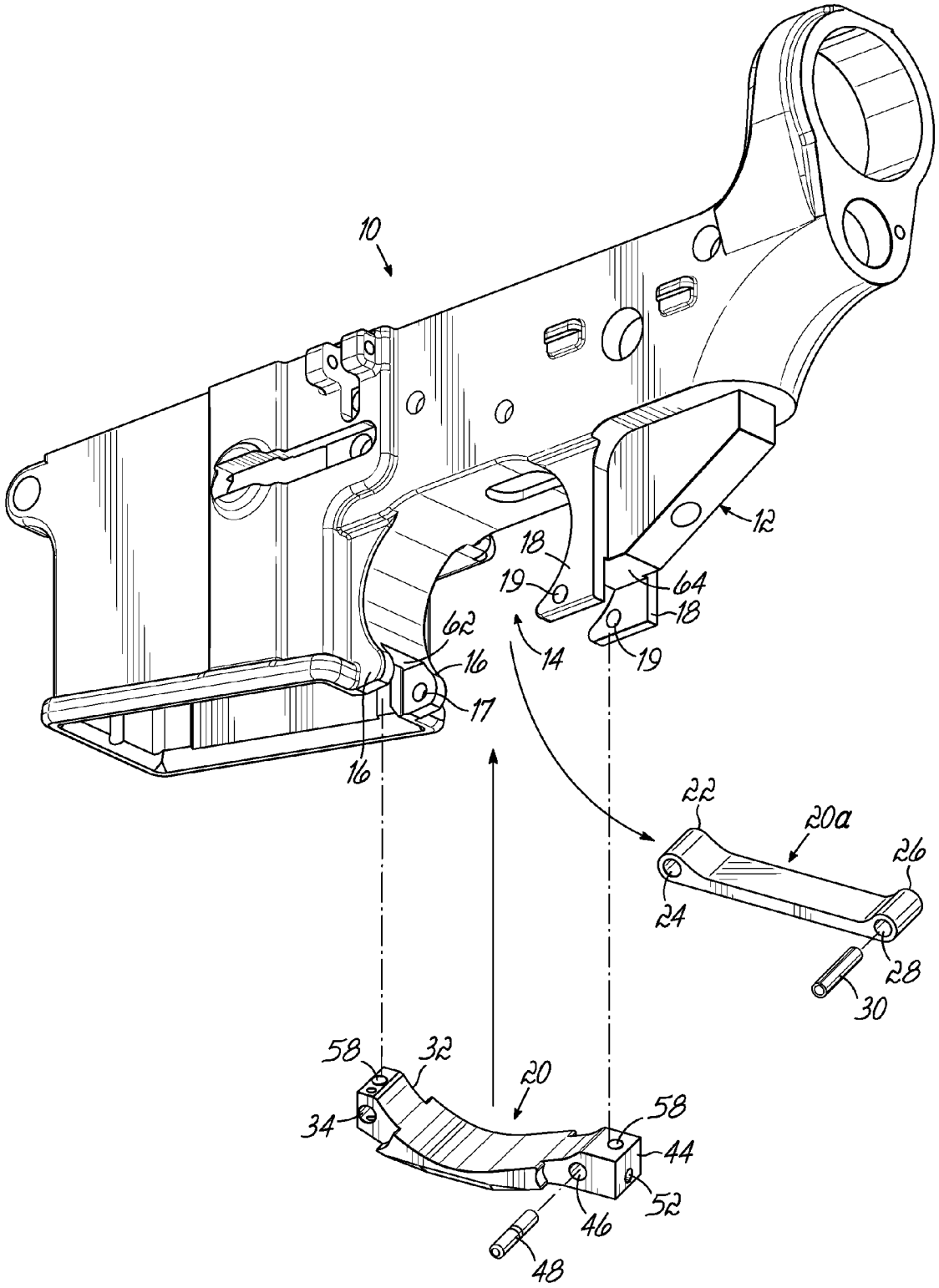
FIG. 1 is an isometric exploded view of an AR15-type lower receiver along with a prior art trigger guard and a trigger guard according to the present invention.

Referring to the various figures of the drawing, and first to FIG. 1, therein is shown at 10 is a standard and well-known AR15-type lower receiver for a firearm. The receiver 10 is shown in a "stripped" condition, wherein it comprises a single piece of material on which none of the additional required parts have been installed.

Among other functions, the lower receiver 10 provides a housing for the various parts that make up the fire control group (not shown). At a lower rear location on the receiver 10, there is a standardized mounting means 12 for a pistol grip. Forward of that location is an area enclosed on forward, upper and rearward sides that defines a trigger area with open left and right sides where the user's finger may be inserted for actuating the trigger. At the lower end of the forward boundary are a pair of spaced-apart forward mounting tabs 16. An opening 17 is provided in the forward tab 16 on the right side for receiving a spring detent, as will be explained in greater detail below. At the bottom end of the rearward boundary, there are right and left rear mounting tabs 18 with transversely aligned openings 19.

A tool-less trigger guard according to the present invention is shown at 20 in FIG. 1. A prior art trigger guard is shown in FIG. 1 at 20*a*. At the forward end 22 of the prior art trigger guard 20*a* is a standard spring detent (not shown) housed in a forward transverse opening 24. At the rear end 26, there is another transverse opening 28 that is sized to receive a roll pin 30.

To install the prior art trigger guard 20*a*, the rear end portion 26 is placed between the rear tabs 18 so that the transverse opening 28 is aligned with the tab openings 19. While supporting the lower receiver body 10 against a solid surface, the roll pin 30 is carefully tapped or pressed through a first tab opening 19, through the rear transverse opening 28 of the trigger guard 20*a*, and then through the opposite tab opening 19. The forward end 22 can then be swung into position, displacing the detent until it is aligned with the detent opening 17. To remove the prior art trigger guard 20*a*, the forward detent is depressed using a tool or small object through the outside of the detent opening 17 to release the forward end 22 of the trigger guard 20*a*. To remove the rear connection, a pin punch or drift must be used to drive the roll pin 30 out of engagement with the rear tab openings 19 and rear transverse opening 28 of the trigger guard 20*a*. This removal procedure again poses some appreciable risk that one of the rear mounting tabs 18 will be broken or damaged.

Figure 2:
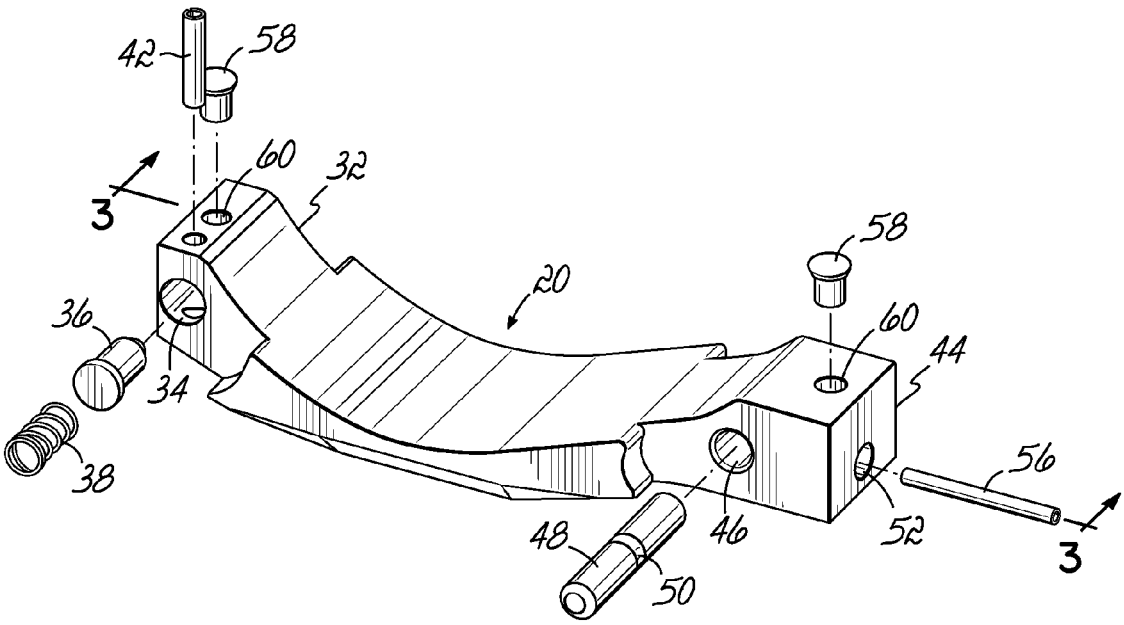
FIG. 2 is an isometric exploded view of a trigger guard according to the present invention.
Figure 3:
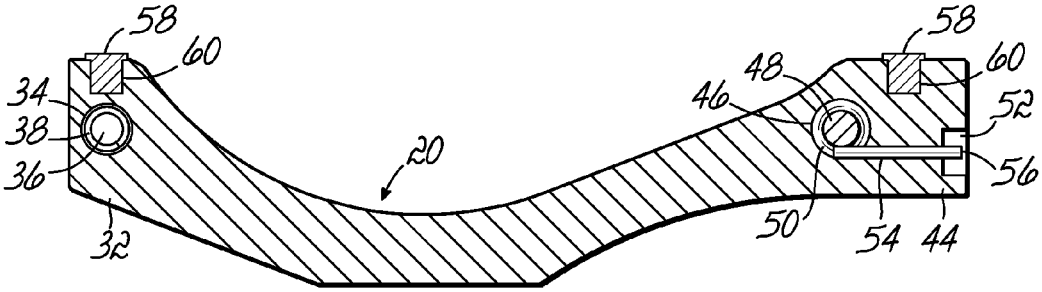
FIG. 3 is a longitudinal side sectional view taken substantially along line 3-3 of FIG. 2.
Figure 4:
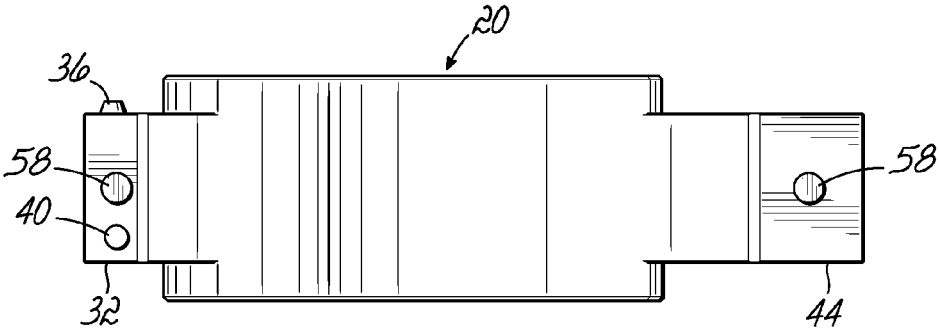
FIG. 4 is a top plan view thereof.
Figure 5:
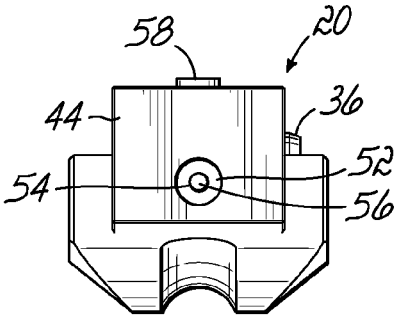
FIG. 5 is a rear end view thereof.
Figure 7:
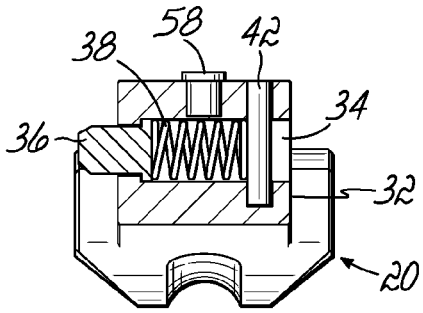
FIG. 7 is a cross sectional view taken substantially along 7-7 of FIG. 6.

Referring now also to FIGS. 2-8, therein is shown the various parts and features that comprise the tool-less trigger guard 20 of the present invention. Describing first the attachment features, at the forward end 32 of the trigger guard body 20 there is a forward transverse opening 34 configured to receive and retain a detent member 36 and a spring 38. A cross bore opening 40 is formed to intersect the transverse opening 34 and receive a retaining pin 42 after insertion of the detent member 36 and spring 38. This forward attachment mechanism is substantially the same as is used for attaching the forward end of a prior art trigger guard 20*a*, described above. At the rear end 44 of the trigger guard body 20 is a rear transverse opening 46 that is positioned to align with the rear tab openings 19 of the lower receiver 10. Rather than being attached by means of a roll pin, the present invention uses a cross pin 48 sized to fit easily through the rear tab openings 19 and the rear transverse opening 46. At a selected point along the length of the cross pin 48, preferably near the center, there is an annular groove 50. A passageway is formed from the rear end 44 of the trigger guard 20 that is positioned to partially intersect with the rear transverse opening 46. Referring now in particular to FIGS. 3 and 5, the passageway includes a first, larger diameter opening 52 of a first, limited depth and a second, smaller diameter opening 54 which extends to a depth sufficient to at least partially intersect the rear transverse opening 46, offset from the center thereof. A wire spring 56 is inserted into the openings 52, 54 and is positioned to engage the groove 50 of the cross pin 48 when it is inserted into the rear transverse opening 46. The smaller diameter opening 54 is sized to closely fit the wire spring 56, holding it in place by friction. The larger diameter opening 52 allows access to an end of the wire spring 56 for removal without having any part of the wire spring 56 protrude beyond the profile of the trigger guard 20.

Installation of the trigger guard 20 may be accomplished without risking damage to the rear mounting tabs 18 of the lower receiver 10. The trigger guard 20 is positioned so that the rear transverse opening 46 is in alignment with the rear tab openings 19. Then the cross pin 48 is inserted through the openings 19, 46 without hammering and without the potentially adverse consequences of forcing an oversized roll pin through the openings 19, 46. The only significant resistance to insertion of the cross pin 48 is as the wire spring 56 is slightly deflected until the cross pin 48 reaches the fully installed position and the wire spring 56 comes to rest in engagement with the annular groove 50. The cross pin 48 can then be removed, if necessary, simply by pushing it out with any object sized to fit within the openings 19, 46. No special tool, such as a hardened pin punch, is required, since no hammering or other impact is necessary.

If desired, buffers 58 made of an elastomeric material, such as nitrile rubber or Buna-N, can be situated at upper surfaces of the forward and rear ward ends 32, 44 of the trigger guard 20. For example, the buffers 58 may be configured to be at least partially received into openings 60 for secure mounting. The buffers 58 are positioned to bear against lower surfaces 62, 64 on the receiver 10 when the trigger guard 20 is installed. Because the cross pin 48 provides a "looser" fit than a roll pin 30, the trigger guard 20 may be allowed some minimal, but undesired, movement. Use of the buffers 58 provides minimal, but adequate, compression force to eliminate any such movement.

Figure 6:
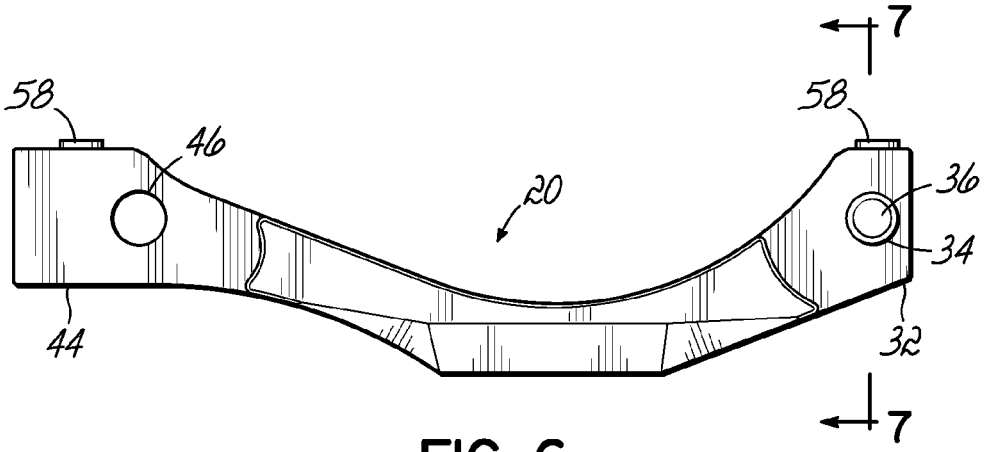
FIG. 6 is a side elevation view thereof.
Figure 8:
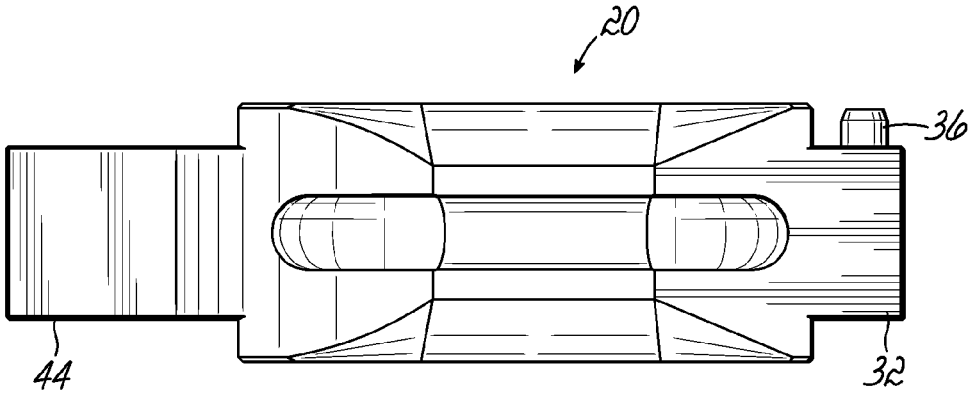
FIG. 8 is a bottom plan view thereof.

The trigger guard 20 of the present invention can be made in any desired functional or ornamental variation. As shown in FIGS. 2, 3 and 6, the illustrated embodiment is provided with an outward (downward) curve to enlarge the trigger area 14 and accommodate a gloved trigger finger. As also shown in FIGS. 2, 4 and 8, the width of the trigger guard 20 between the forward and rearward ends 32, 44 can be widened to substantially match the overall width and contour of the forward and rear mounting tabs 16, 18.

While an exemplary embodiment of the present invention has been described in detail, it should be apparent that modifications and variations thereto are possible, all of which fall within the true spirit and scope of the invention. Therefore, the foregoing is considered as illustrative only of the principles of the invention and, since modifications and changes will be apparent to those skilled in the art, it is not intended to limit the invention to the exact construction and operation shown and described. Accordingly, all suitable modifications and equivalents may be resorted to, falling within the scope of the invention.

What is claimed is:

1. A trigger guard for an firearm lower receiver, attachable and removable without application of impact force, comprising:

an elongated trigger guard member having forward and rear ends with a rear transverse opening positioned to align with mounting openings on the receiver;

a mounting pin having a size no greater in cross-section than that of the mounting openings on the receiver and a spring engagement means thereon; and deflectable spring means operably positioned in the transverse opening to be deflected when the pin is inserted in the transverse opening and to engage the spring engagement means on the mounting pin when the mounting pin reaches a preselected position.

2. The trigger guard of claim 1, wherein the trigger guard member is curved to provide an enlarged trigger opening.

3. The trigger guard of claim 1, further comprising at least one elastomeric buffer member positioned on the trigger guard member to contact a surface of the receiver when installed to prevent movement between the installed trigger guard and the receiver.

4. The trigger guard of claim 3, comprising elastomeric buffer members adjacent the forward and rear ends of the trigger guard member.

5. A trigger guard for an receiver, attachable and removable without application of impact force, comprising:

an elongated trigger guard member having forward and rear ends with a rear transverse opening positioned to align with mounting openings on the receiver;

a mounting pin having a size no greater in cross-section than that of the mounting openings on the receiver and an annular detent engagement groove thereon; and a deflectable detent member operably positioned in the transverse opening to be deflected when the pin is inserted in the transverse opening and to engage the detent engagement groove when the mounting pin reaches a preselected position.

6. The trigger guard of claim 5, wherein the trigger guard member is curved to provide an enlarged trigger opening.

7. The trigger guard of claim 5, further comprising at least one elastomeric buffer member positioned on the trigger guard member to contact a surface of the receiver when installed to prevent movement between the installed trigger guard and the receiver.

8. The trigger guard of claim 7, comprising elastomeric buffer members adjacent the forward and rear ends of the trigger guard member.

* * * * *